US011413785B2

(12) United States Patent
Babini et al.

(10) Patent No.: US 11,413,785 B2
(45) Date of Patent: Aug. 16, 2022

(54) DEVICE FOR COMPACTING POWDER MATERIAL, IN PARTICULAR CERAMIC MATERIAL

(71) Applicant: SACMI COOPERATIVA MECCANICI IMOLA SOCIETA COOPERATIVA, Imola (IT)

(72) Inventors: Alan Babini, Imola (IT); Marco Salieri, Imola (IT); Silvano Valli, Imola (IT)

(73) Assignee: SACMI COOPERATIVA MECCANICI IMOLA SOCIETA COOPERATIVA, Imola (IT)

( * ) Notice: Subject to any disclaimer, the term of this patent is extended or adjusted under 35 U.S.C. 154(b) by 0 days.

(21) Appl. No.: 16/332,062

(22) PCT Filed: Sep. 12, 2017

(86) PCT No.: PCT/IB2017/055493
§ 371 (c)(1),
(2) Date: Mar. 11, 2019

(87) PCT Pub. No.: WO2018/047146
PCT Pub. Date: Mar. 15, 2018

(65) Prior Publication Data

US 2019/0358851 A1 Nov. 28, 2019

(30) Foreign Application Priority Data

Sep. 12, 2016 (IT) ..... 102016000091618

(51) Int. Cl.
*B28B 3/12* (2006.01)
*B30B 5/06* (2006.01)
*B28B 5/02* (2006.01)

(52) U.S. Cl.
CPC ..... *B28B 3/123* (2013.01); *B30B 5/06* (2013.01); *B30B 5/062* (2013.01); *B28B 5/02* (2013.01); *B28B 5/027* (2013.01)

(58) Field of Classification Search
CPC ..... B28B 3/123; B28B 5/027; B28B 5/02; B30B 5/06; B30B 5/062
See application file for complete search history.

(56) References Cited

U.S. PATENT DOCUMENTS 3,981,666 A * 9/1976 Wadman ..... B30B 5/062 425/371
4,025,272 A 5/1977 Camp
(Continued)

FOREIGN PATENT DOCUMENTS

CA 977263 A 11/1975
EP 1226927 A2 7/2002
(Continued)

OTHER PUBLICATIONS

Farid Al-Bender, "On the modelling of the dynamic characteristics of aerostatic bearing films: From stability analysis to active compensation", 2009, Precision Engineering, 33.2, pp. 117-126. (Year: 2009).*

(Continued)

*Primary Examiner* — Jerzi H Moreno Hernandez
(74) *Attorney, Agent, or Firm* — Workman Nydegger

(57) ABSTRACT

A device (100) for compacting a layer (MT) of powder material; the device (100) comprises a movable surface (12), which is designed to convey the layer (MT) of powder material in a predefined feeding direction (F); a compacting belt (22) positioned over the transport surface (12); a pressing station (40, 45, 50, 55), which is designed to press the compacting belt (22) towards the transport surface (12), so as to press the layer (MT) of powder material; and an expansion countering station (80), which is designed to (Continued)

counter the expansion of the layer (MT) of powder material downstream of the pressing station (40, 45, 50, 55) and comprises a pusher delivering a gas under pressure to create a pushing gas cushion (STR; STR*) on the compacting belt (22).

10 Claims, 4 Drawing Sheets

(56) References Cited

U.S. PATENT DOCUMENTS

| | | | | |
|---|---|---|---|---|
| 4,278,624 | A * | 7/1981 | Kornylak | B29C 31/00 264/37.16 |
| 4,495,021 | A * | 1/1985 | Goldsworthy | B29C 53/564 156/172 |
| 4,541,889 | A | 9/1985 | Held | |
| 4,988,478 | A * | 1/1991 | Held | B27N 1/02 264/120 |

FOREIGN PATENT DOCUMENTS

| | | | |
|---|---|---|---|
| EP | 1585620 | A1 | 10/2005 |
| GB | 815441 | A | 6/1959 |
| WO | 2013050865 | A1 | 4/2013 |
| WO | 2014046810 | A1 | 3/2014 |

OTHER PUBLICATIONS

International Search Report and Written Opinion issued in Application No. PCT/IB2017/055493 dated Dec. 14, 2017.

* cited by examiner

SEZ.II-II

DEVICE FOR COMPACTING POWDER MATERIAL, IN PARTICULAR CERAMIC MATERIAL

CROSS REFERENCE TO RELATED APPLICATIONS

This application is a U.S. Nationalization of PCT Application Number PCT/IB2017/055493, filed on Sep. 12, 2017, which claims priority to IT Patent Application No. 102016000091618 filed on Sep. 12, 2016, the entireties of which are incorporated herein by reference.

TECHNICAL FIELD

The present invention concerns a device for compacting a layer of powder material, in particular ceramic powder.

BACKGROUND OF THE INVENTION

In the ceramic industry devices are known for forming tiles which comprise a flexible conveyor belt on which a ceramic powder is gradually deposited.

The powder layer is fed forward by the transport surface through a continuous type compacting station, which is designed to compact the powder layer as it moves forward on the transport surface.

The compacting station generally comprises two flexible compacting surfaces, one on top of the other, and both sliding in the same direction as the conveyor belt.

Normally, each compacting surface is defined by a respective flexible sliding belt.

The lower compacting surface is positioned below and in direct contact with the transport surface in order to support it by resting against it; the upper compacting surface is positioned at a certain distance above the transport surface below.

Furthermore, the upper compacting surface acts directly on the layer of powder in transit.

In a predefined area, the compacting surfaces are guided by pressing means, for example a pair of overlapping rollers, which maintain the upper compacting surface locally pressed towards the lower compacting surface, so as to press the layer of powder transported by the conveyor belt.

The compacting station normally also comprises two parallel lateral sides, which are designed to laterally contain the layer of ceramic powder on the transport surface during compacting, so as to make the apparent density of the powder layer more uniform widthways. Downstream of the compacting station, the transport surface moves the compacted powder layer forward through a successive cutting station, which is designed to split it into single sheets of the desired dimensions.

Furthermore, as is known, immediately downstream of the pressing means, the compacted powder layer tends to spontaneously expand.

Due to this spontaneous expansion, the entity of which is generally proportional to the compacting pressure, the powder layer can break and form cracks and/or fissures which make it completely unusable, or in any case seriously defective.

To overcome this drawback, immediately downstream of the pressing means, the compacting station is normally also provided with means for countering the expansion of the compacted powder layer. These countering means have the function of "accompanying" the expansion, i.e. slowing it down, so as to prevent the formation of cracks and/or fissures in the compacted powder layer.

The expansion countering means can comprise a pair of overlapped plates, between which the compacting surfaces are guided to pass downstream of the pressing means.

These plates have the function of keeping the upper compacting surface pressed in the direction of the lower compacting surface, so that the powder layer already compacted by the rollers undergoes a further expansion countering pressure.

Nevertheless, said further expansion countering pressure is always lower than the compacting pressure exerted by the rollers.

The European patent EP-B1-1 585 620 (SACMI) describes a solution to the above-mentioned problem of post-expansion of the material in transit in which a flexible sheet is used, supported by a row of hydraulic jacks arranged beside each other in a transverse direction with respect to the feeding direction of the conveyor belt.

In particular, the fluid is fed into the cylinders of the jacks by means of one single manifold, so that each piston is always subject to the same pressure.

In this way, the flexible sheet behaves substantially like a sort of buffer, which exerts a constant uniform pressure on the underlying upper compacting surface.

Although this solution provides good results, it has been found that the expansion countering effect obtained with the flexible sheet outlined above is not always uniform throughout the width of the powder layer.

In particular, it has been found that the expansion of the powder is countered more effectively in the centre of the layer rather than at the lateral edges, with the result that undesired cracks and/or fissures can still occur along the lateral edges.

To remedy this problem, in the international application WO-A1-2013/050865 (SACMI) a solution is proposed in which the means for countering the expansion of the powder material layer downstream of the pressing means are configured to press the compacting surface towards the transport surface with a differentiated pressure crosswise to the feeding direction.

In this way it is advantageously possible to adjust the pressure exerted by the counter means at the edges of the compacting surface in a manner different from the pressure exerted at the centre, in order to effectively counter the expansion of the powder material layer also along the sides.

In particular, it is advantageously possible to adjust the pressure exerted by the counter means so as to guarantee that the counter pressure actually transmitted to the powder material layer is substantially constant throughout the width of the layer.

Although the two previous solutions have provided good results, they have also showed some criticalities which the present invention aims to overcome.

In this regard, it is interesting to note that the use of counteracting sliding blocks to control the expansion of the material after compression results in a high level of friction between the belt (made of steel) and the sliding block (made of a plastic material, normally polyethylene) i.e. tangential forces acting on the belt.

This has the following negative consequences:

- high resistance action to the movement of the belt, which can be such as to make the forward feed impossible if said resistance action exceeds the maximum torque that can be transmitted by the belt drive rollers;
- high wear on the pushers, hence they have to be periodically checked and replaced if necessary;

high risk that a portion of the powder to be compressed becomes lodged between the flexible pushing sheets with increase in the wear on the belts described in the preceding point, resulting in the occurrence of breakages in the end product;

the friction forces together with the powder can cause defects on the inner surface of the steel belt, affecting the end product.

It is further known that it is not possible to reduce the friction force using lubricants, as they would inevitably be distributed on the inner surface of the belt, thus changing the adherence conditions between belt and drive roller with a drastic reduction in the transmittable torque and therefore the sliding of the belt.

The object of the present invention is to provide a device for compacting a layer of powder material, which overcomes, at least partially, the drawbacks of the known art and at the same time is easy and inexpensive to produce.

SUMMARY

According to the present invention, therefore, a device is produced for compacting a layer of powder material, as claimed in claim 1 or in any one of the claims depending directly or indirectly on claim 1.

BRIEF DESCRIPTION OF THE FIGURES

The invention is described below with reference to the accompanying drawings, which illustrate some non-limiting embodiment examples, in which.

DETAILED DISCLOSURE

Figure 1:
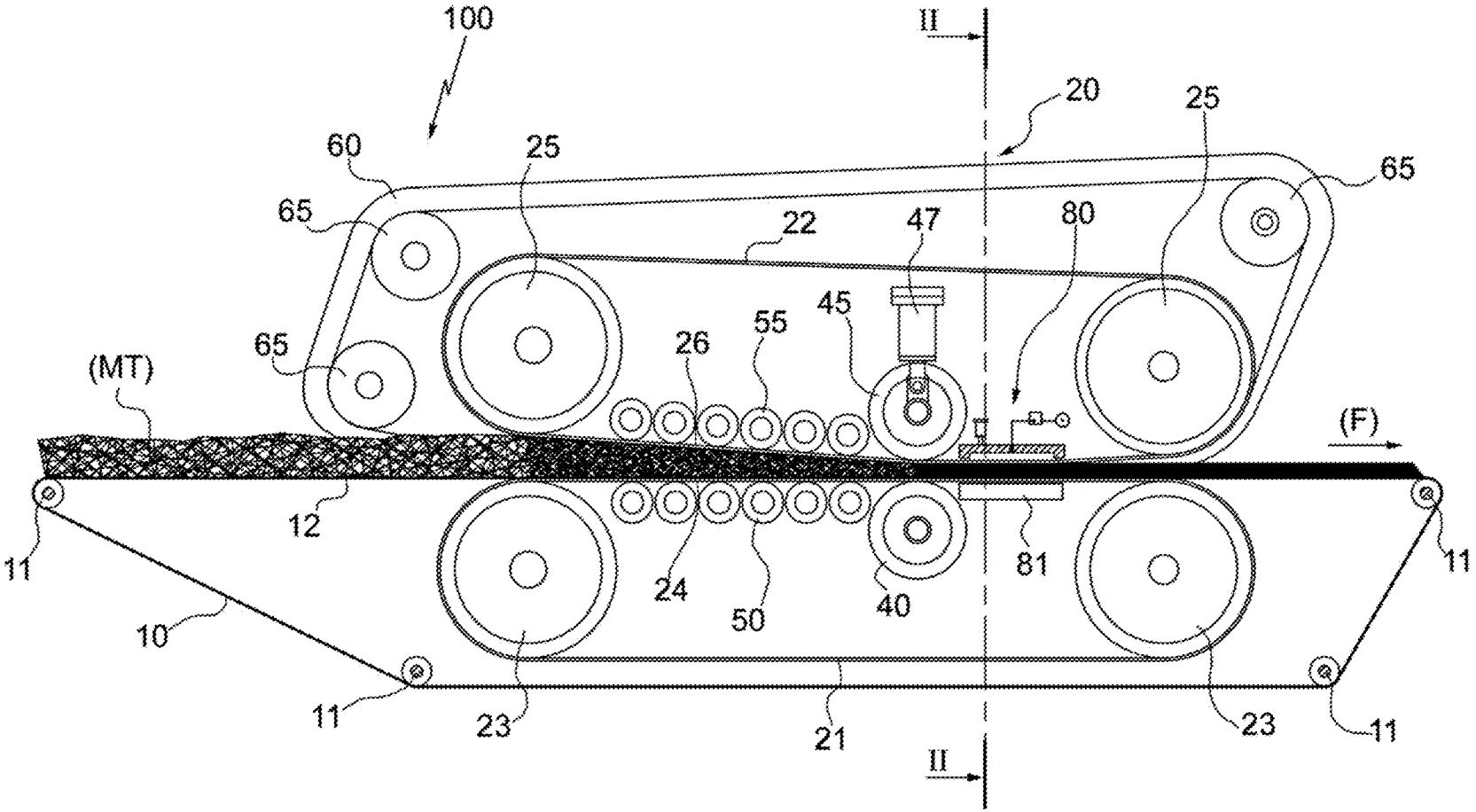
FIG. 1 illustrates a schematic lateral view of a device for compacting a layer of powder material according to the present invention.

In FIG. 1, the number 100 indicates, overall, a device for compacting a layer (MT) of powder material comprising ceramic powder. In particular, the device 100 can be used in a system for forming tiles or ceramic sheets. More precisely, the powder material is ceramic powder.

According to the specific embodiment illustrated (not limiting), the device 100 comprises a flexible conveyor belt 10, which is wound in a closed loop around a plurality of rollers 11 with horizontal axis, including a series of idle relay rollers and at least one motorized drive roller designed to operate the conveyor belt 10.

In some cases, the conveyor belt 10 can be made of plastic material or, more frequently, steel. In particular, the upper section of the conveyor belt 10, substantially horizontal, defines a movable transport surface 12 designed to support the layer (MT) of powder material and feed it forward in a predefined feed direction (F).

In use, the layer (MT) of powder material is fed forward by the transport surface 12 through a compacting station 20 of continuous type, which is designed to compact the layer (MT) of powder material as it is fed forward.

The compacting station 20 comprises, in turn, two flexible compacting belts, reciprocally overlapping: one lower compacting belt 21 and one upper compacting belt 22. Both the compacting belts 21 and 22 can be made of plastic or steel.

The compacting belt 21 is wound in a closed loop around a pair of rollers 23 with horizontal axis, one idle relay roller and one motorized drive roller designed to induce the movement of the compacting belt 21.

The upper part of the compacting belt 21, substantially horizontal, defines a sliding compacting lower surface 24 positioned below and in direct contact with the transport surface 12, so as to support it by resting against it.

Furthermore, the sliding compacting surface 24 is operated to slide in the same feed direction (F) and substantially at the same speed as the transport surface 12, so as to avoid relative slipping.

The compacting belt 22 is wound, in turn, in a closed loop around a pair of rollers 25 with horizontal axis, one idle relay roller and one motorized drive roller, designed to operate the compacting belt 22.

The lower part of the compacting belt 22 defines a sliding compacting surface 26 which is positioned above the transport surface 12, and is spaced from the latter so as to leave a gap for passage of the layer (MT) of powder material.

In use, the compacting surface 26 is moved to slide substantially in the same feed direction (F) and substantially at the same speed as the transport surface 12, in order to avoid reciprocal slipping with the layer (MT) of powder material.

The compacting station 20 further comprises appropriate pressing means (pressing device), which are designed to keep the compacting surface 26 locally pressed towards the transport surface 12, so as to compress the layer (MT) of powder material interposed between them.

In the example illustrated, the pressing means comprise a pair of pressing rollers 40, 45 reciprocally overlapping, one lower pressing roller 40 and one upper pressing roller 45, which have horizontal rotation axes orthogonal to the feed direction (F).

The lower pressing roller 40 is positioned below and in direct contact with the compacting belt 21 at the lower compacting surface 24, and is positioned at a distance such as to maintain the substantial planarity of the transport surface 12.

The upper pressing roller 45 is positioned above and in direct contact with the inner face of the compacting belt 22 at the compacting surface 26, and is positioned at a distance such as to locally bring the compacting surface 26 towards the transport surface 12, so as to reduce the thickness of the gap defined between them and thereby compact the layer (MT) of powder material.

The lower pressing roller 40 is mounted fixed, whereas the upper pressing roller 45 is carried by jacks 47 which allow modification of the distance with respect to the lower pressing roller 40 and/or the force applied, for example according to the thickness of the layer (MT) of powder material to be compacted and/or the compacting pressure to be applied on it.

To make compacting of the layer (MT) of powder material more gradual, the pressing means can also comprise a pair of reciprocally overlapping roller units 50, 55, a lower roller unit 50 and an upper roller unit 55, which are positioned upstream of the pressing rollers 40 and 45 with respect to the feed direction (F).

Both the roller units 50 and 55 comprise rollers having horizontal rotation axes orthogonal to the feed direction (F).

The rollers of the lower roller unit 50 are positioned below and in contact with the compacting belt 21 at the lower compacting surface 24, are arranged on a plane parallel to the feed direction (F), and are positioned at a distance such as to maintain the planarity of the transport surface 12.

The rollers of the upper roller unit 55 are positioned above and in contact with the compacting belt 22 at the compacting surface 26, are arranged on a plane inclined from top to bottom with respect to the feed direction (F), and are positioned at a distance such as to bring the compacting surface 26 gradually nearer the transport surface 12, thus progressively reducing the thickness of the gap between them, thereby gradually compacting the layer (MT) of powder material.

To improve the compacting uniformity of the powder material in the widthways direction of the layer (MT), the compacting station 20 also comprises means for laterally containing the layer (MT) of powder material.

In the example illustrated, said containment means comprise a pair of sliding belts, 60 and 70 respectively, which are both positioned above the conveyor belt 10.

Each sliding belt 60 and 70 is flexible and wound in a closed loop around a respective plurality of rollers 65 with horizontal axis (visible only in FIG. 1), comprising a series of idle relay rollers and if necessary a motorized drive roller which allows the belt to slide.

In particular, the sliding belts 60 and 70 are configured and operated so that the lower part of each of them, substantially horizontal, is designed to slide in the same feed direction (F) and substantially at the same speed as the transport surface 12.

Figure 2:
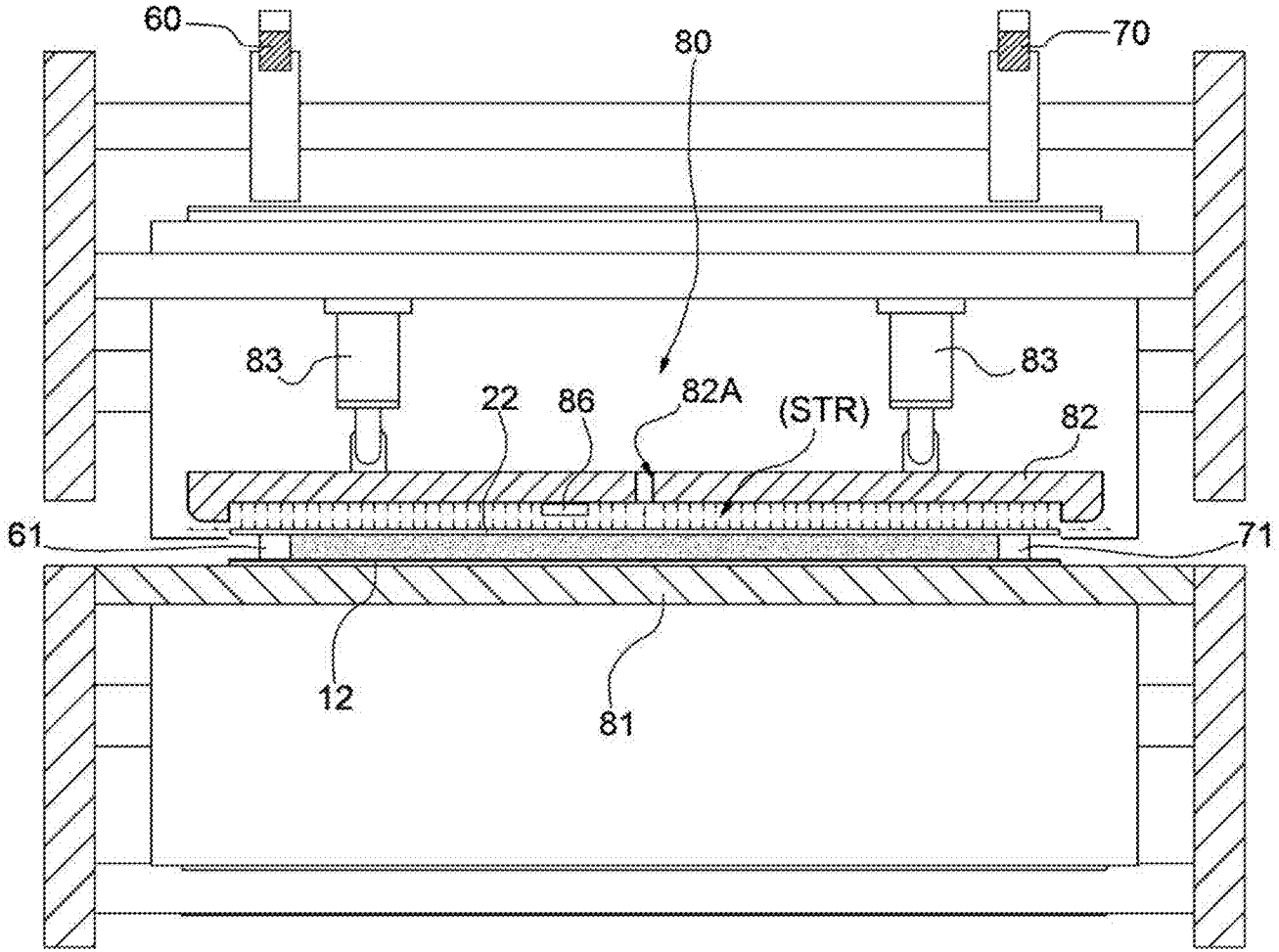
FIG. 2 shows a section II-II of FIG. 1 on an enlarged scale.

As illustrated in FIG. 2, the lower parts of the sliding belts 60 and 70 are both positioned resting on the transport surface 12, in a position interposed between the latter and the compacting surface 26, thus defining two parallel and reciprocally spaced sides 61 and 71 which are designed to laterally contain the layer (MT) of powder material during compacting.

The sliding belts 60 and 70 are made of a yielding material in terms of thickness, for example rubber or other plastic material, so that the containment sides 61 and 71 defined by them can elastically compress between the compacting surfaces 24 and 26.

Downstream (more precisely, immediately downstream) of the pressing means, the device 100 also comprises an expansion countering device 80 to which the layer (MT) of (compacted) powder material is spontaneously subjected after the compacting phase.

More in particular, the expansion countering device 80 has the function of "accompanying" the expansion of the (compacted) powder material, i.e. limiting the entity thereof and/or slowing it down (without blocking it), so as to avoid the formation of cracks and/or fissures in the layer (MT) after the compacting operation.

More specifically, the expansion countering device 80 is designed to accompany the expansion of the material by exerting a pressure on the (compacted) powder material such as to limit (control) its expansion without preventing it.

Additionally or alternatively, the expansion countering device 80 is designed to accompany the expansion of the (compacted) material by exerting a pressure on the (compacted) powder material such as to slow down its expansion without preventing it.

According to the non-limiting embodiment illustrated in the figures (see for example FIG. 2), the expansion countering device 80 comprises a lower plate 81, which is positioned below and in direct contact with the lower compacting surface 24.

The lower plate 81 is substantially horizontal and positioned at a distance such as to maintain the planarity of the movable surface 12.

Advantageously but not necessarily, the expansion countering device 80 further comprises a pushing unit, which is arranged at (in particular, above) the lower plate 81 and (in particular, above) the compacting surface 26. In particular, the pushing unit comprises (more precisely, is) a pusher 82.

Advantageously but not necessarily, the pushing unit (in particular, the pusher 82) is supported and pushed by means of hydraulic jacks 83 which allow variation of the distance thereof with respect to the compacting surface 26, for example according to the thickness of the layer (MT) of (compacted) powder material and for purposes which will be explained better below with reference to FIGS. 3, 4 (see below).

Furthermore, according to some non-limiting embodiments, as can be seen in FIG. 2, the pusher 82 can oscillate with respect to the jacks 83 so that it can be inclined with respect to the transport surface 12 and with respect to the compacting belt 22.

Operation of the jacks 83 is of the hydraulic type traditionally used in this kind of system.

In particular, each jack 83 is in fluid communication with a hydraulic operating unit 90 comprising a tank 91 from which a pump 92 draws oil by means of a suction duct 93.

The oil is supplied under pressure to the jack 83 by means of a delivery duct 94.

The delivery duct 94, in turn, is provided with a pressure-regulating valve 95 (with respective exhaust 96), and a pressure sensor 97 positioned on the same delivery duct 94 downstream of the pressure-regulating valve 95.

The entire hydraulic operating unit 90 is electronically connected, furthermore, to an electronic control unit (CC) (FIG. 3A), which is programmed to control the operation of the pump 92 and/or of the pressure-regulating valves 95, so as to guarantee that the fluid supplied to the jack 83 arrives at the jack 83 with precise pressures and flow rates.

According to some non-limiting embodiments (like the one illustrated in FIGS. 3A and 3B), the pusher 82 assumes the form of a sliding block with a substantially rectangular shape.

Advantageously but not necessarily, the pusher 82 is provided with a central recess 84 (i.e. a cavity, a niche) (in particular, of a substantially rectangular shape) and such as (structured in order to) define a peripheral projecting edge 85.

In particular, a gas under pressure is conveyed into the pusher 82 (more precisely, into the recess 84) by means of a pneumatic operating unit 98.

According to different embodiments, the gas under pressure can be air, or any gas, in particular an inert gas like nitrogen, for example.

In particular, the pneumatic operating unit 98, in turn, comprises a compressor 99A, and a gas supply duct 99B by means of which the gas under pressure is supplied towards an opening 82A through which it flows into the above-mentioned recess 84.

The gas pressure can be modulated by means of a pressure-regulating valve 99C positioned in the above-mentioned gas supply duct 99B.

The pneumatic operating unit 98 is electronically connected, furthermore, to the electronic control unit (CC), or to other independent electronic means for command and control of the working parameters of the gas under pressure.

In use, the control unit (CC), acting in a programmed manner (if necessary in feedback) on the operating parameters of the hydraulic operating unit 90 and/or of the pneumatic operating unit 98, ensures that the pusher 82 exerts on the compacting belt below 22 the force necessary to control expansion of the material after compression, and is arranged spaced with respect to the compacting belt 22, thus creating a cushion (STR) and thereby avoiding direct contact between the peripheral projecting edge 85 of the pusher 82 (sliding block) and the inner (upper) surface of the compacting belt 22. In some cases, a gas flow (AFLW) flows out of the cushion (STR) towards the outside.

In other words, the positioning of the pusher 82 with respect to the compacting belt 22 below is achieved by programmed operation of the jacks 83 and/or the pushing action of the gas under pressure against the surface 22 (hovercraft effect).

Advantageously but not necessarily, the pusher 82 (more precisely, the recess 84) is, if necessary, provided with one or more sensors 86 designed to detect characteristics such as speed, pressure etc. of the gas instantly located in the cushion (STR), and if necessary the physical parameters (for example the flow rate) of the gas (AFLW).

The action performed on the compacting belt 22 by the expansion countering device 80 is countered by the fixed lower plate 81 on which, as we have said, the conveying surface 12 is pressed by the layer of (compacted) powder material (MT) in transit.

Note that the compression action exerted (in particular, by the countering device 80; more in particular by the pushing unit; even more in particular by the pusher 82) on the powder material (MT) in transit will be in general inferior to the compression action performed in the preceding compacting station (rollers 40, 45 and any roller units 50, 55—pressing device), so that the (compacted) powder material can in any case expand but in a controlled manner, therefore without the formation of cracks or fissures in the compacted layer (MT).

In particular, the pressing means (more precisely, the pressing device) are designed to exert a first pressure on the (compacted) powder material greater than a second pressure exerted on the (compacted) powder material by the pushing unit (more precisely by the pusher). In particular, the pushing unit (more precisely the pusher 82) is designed to exert the second pressure on the (compacted) powder material acting on the compacting belt 22.

Advantageously but not necessarily, the first pressure is at least ten times (in particular, at least fifty times) greater than the second pressure.

According to specific embodiments, the first pressure is 250 bar (in particular, 350 bar) to 500 bar (in particular, 450 bar) (more precisely, approximately 400 bar) and the second pressure is 1 (in particular, 2) to 10 (in particular, 7) bar (more precisely, up to 6 bar).

Figures 3A, 3B:
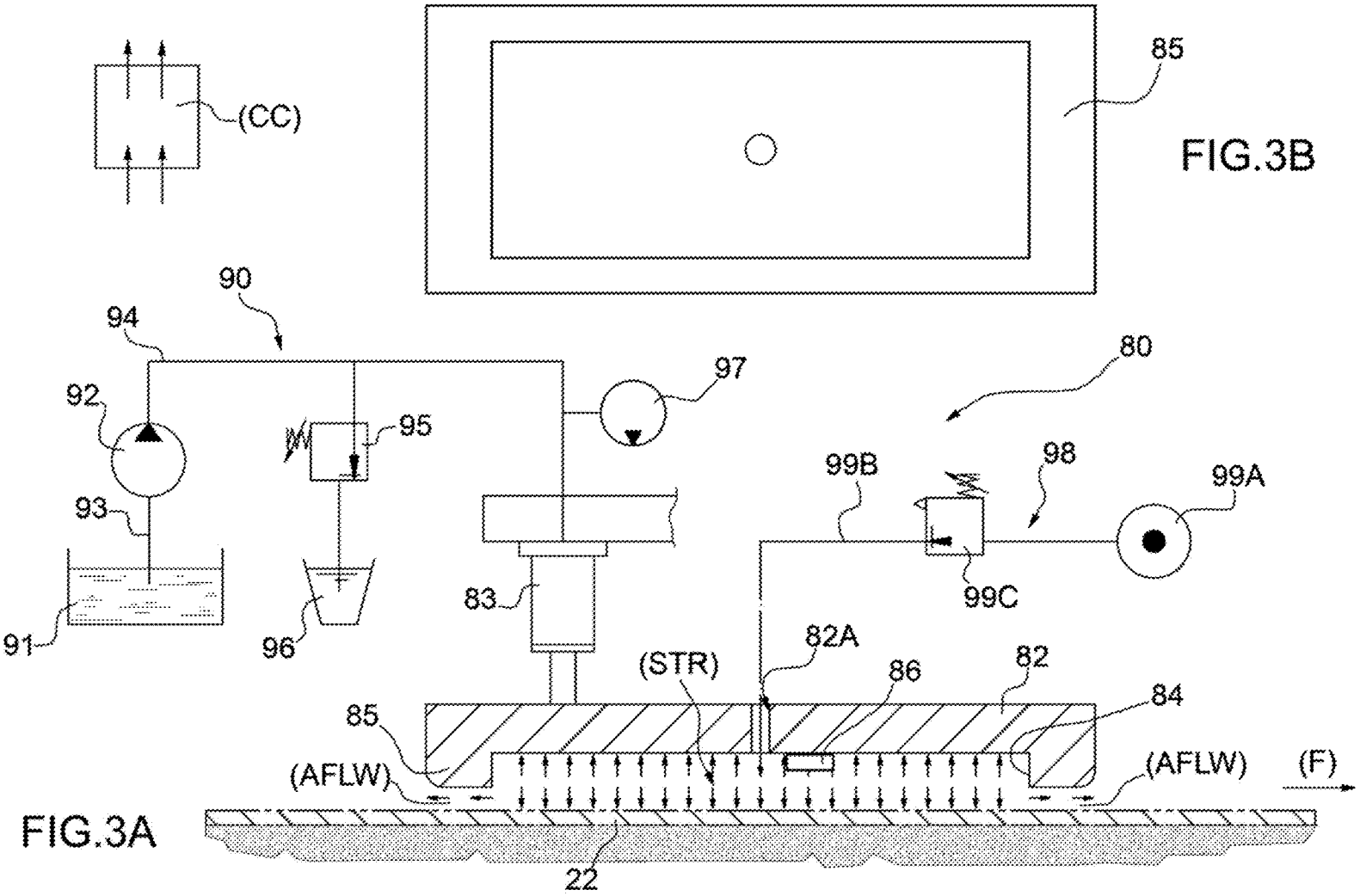
FIG. 3A illustrates a first embodiment of a detail of the device shown in FIGS. 1 and 2 provided with relative actuation means.
FIG. 3B shows a plan view of the detail of FIG. 3A.
Figures 4A, 4B:
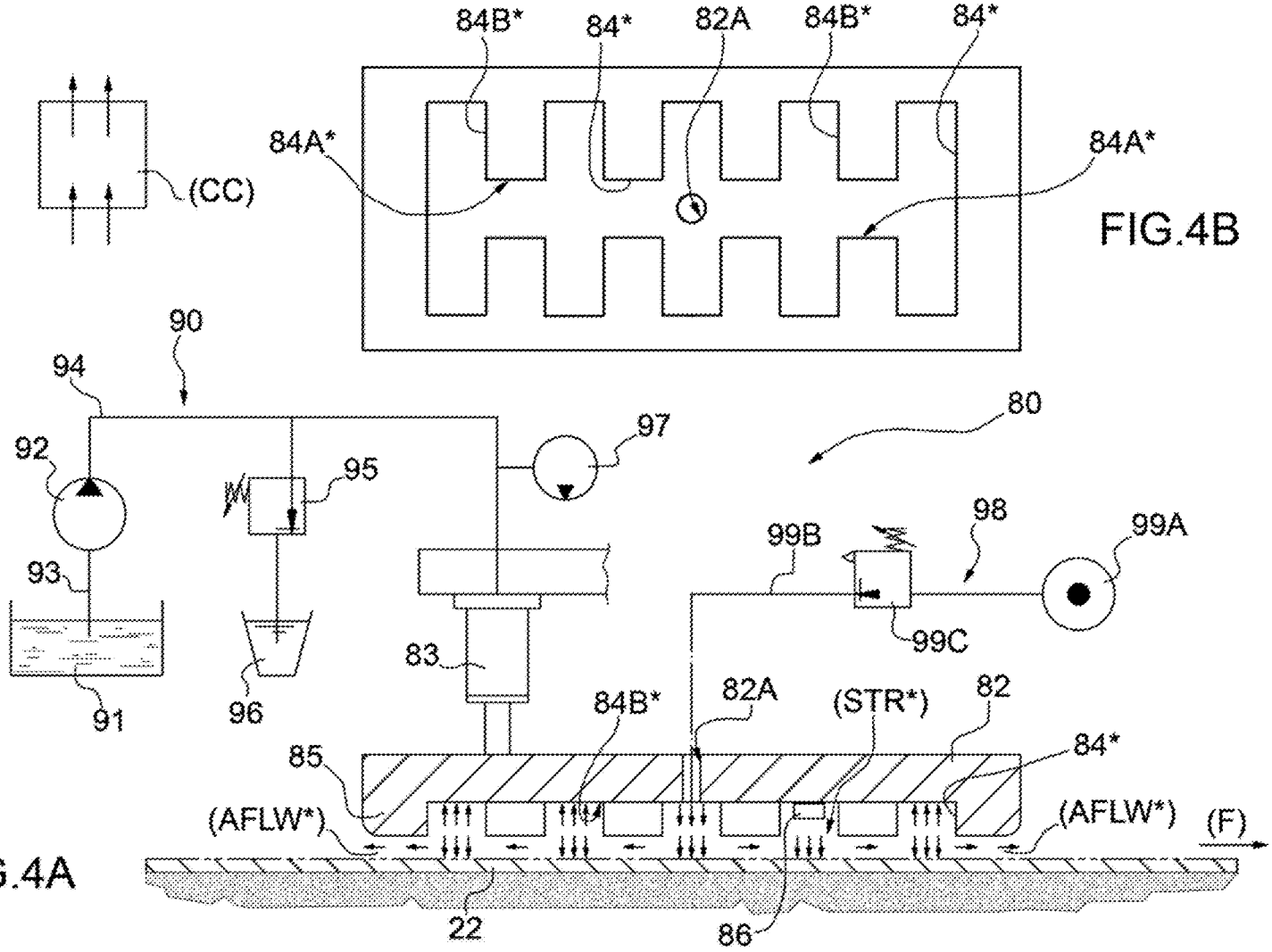
FIG. 4A illustrates a second embodiment of a detail of the device shown in FIGS. 1 and 2 provided with relative actuation means.
FIG. 4B shows a plan view of the detail of FIG. 4A.

Further non-limiting embodiments (like those illustrated in FIGS. 4A, 4B) differ from the embodiments of FIGS. 3A, 3B only due to the fact that the recess 84* comprises a main channel 84A* from which secondary channels 84B* branch, the direction of which is transverse (more precisely, substantially perpendicular) to that of the main channel 84A*.

In use, the gas under pressure is supplied towards the opening 82A and distributed between the main channel 84A* and the secondary channels 84B* to create a cushion (STR*) (from which a gas flow (AFLW*) flows out towards the outside) in the same way as seen for the first embodiment.

According to other non-limiting embodiments not illustrated, a person skilled in the art can shape the recess so as to obtain, each time, the formation of a cushion advantageous in terms of the pushing action on the belt below.

In other words, the present invention exploits a sort of "hovercraft effect" to constitute a gaseous cushion for pushing the belt.

Advantageously, the pusher (sliding block) 82 has a (lower) face facing the compacting surface 26. According to a further non-limiting embodiment not illustrated, the pusher 82 is provided with means for supplying compressed gas through said (lower) face. In particular, said face is flat (i.e. not hollow).

In particular, supply of the compressed gas through the (lower flat) face could be obtained, for example, by means of a plurality of feed channels substantially perpendicular to the (lower flat) face.

Alternatively or additionally, the pusher comprises (could be made of) a material "porous to gases" (in particular, porous to air).

In this regard, porous materials are known with a plastic or metallic matrix which allow the passage of a compressed gas, again for the purpose of forming a pressure/support cushion for the sliding block.

Advantageously, the (lower flat) face is provided, if necessary, with one or more sensors 86 adapted to detect characteristics such as speed, pressure etc. of the gas instantly located in the cushion, and if necessary the physical parameters of the gas flow towards the external environment.

The main advantages of the device subject of the present invention are the following:

- drastic reduction in the friction forces acting on the belt, since direct contact between belt and pusher is reduced or annulled;
- considerable reduction in traction problems on the belts present in the device;
- significant reduction in wear on the pusher (sliding block); furthermore
- the gas flowing out of the pusher (sliding block) prevents the powder from penetrating inside the pusher, keeping it clean and avoiding wear and the occurrence of defects on the belt.

The invention claimed is:

1. A device for compacting a layer of powder material comprising ceramic powder, the device comprising:

- a movable surface, which is configured to substantially move together with the layer of powder material in a predefined feeding direction;
- a compacting belt, which is provided with a compacting surface facing the movable surface and is substantially movable in the feeding direction;
- a pressing device, which is configured to press the compacting surface towards the movable surface, so as to press the layer of powder material interposed between them; and
- an expansion countering device, which is configured to act upon the compacting belt, so as to partially counter expansion of the layer of powder material downstream of said pressing device;
- wherein the expansion countering device comprises a pushing unit, which is configured to release a gas under pressure, so as to create a pushing gas cushion on said compacting belt in order to exert, upon said compacting belt, a compression action that partially counters the expansion of the layer of powder material downstream of the pressing device, wherein the pressing device is configured to exert a first pressure on the layer of powder material at least ten times greater than a second pressure exerted on the layer of powder material by the pushing unit;

the pushing gas cushion being created where the device is configured to let the layer of powder material expand;

wherein the pushing unit comprises at least one pusher, which is supplied with the gas under pressure, so that said at least one pusher is separated relative to said compacting belt by means of said pushing gas cushion;

wherein the compacting surface is arranged between the at least one pusher and the movable surface;

wherein said pushing unit further comprises at least one sensor, which is designed to detect speed and pressure of the gas located in said pushing gas cushion and one or more physical parameters of the gas flowing out of said pushing gas cushion into an external environment;

wherein said at least one sensor is designed to detect a flow rate of the gas flowing out of said pushing gas cushion into the external environment;

wherein said expansion countering device further comprises:

an electronic control unit;

a hydraulic operating unit configured for allowing variation of a distance of the pushing unit with respect to the compacting surface; and a pneumatic operating unit configured for supplying the gas under pressure to the at least one pusher, the pneumatic operating unit comprising a compressor and a gas supply duct by means of which the gas under pressure is supplied into a recess of the at least one pusher;

wherein the hydraulic operating unit and the pneumatic operating unit are connected to the electronic control unit; and wherein the electronic control unit is programmed to control operating parameters of the hydraulic operating unit and the pneumatic operating unit such that i) said at least one pusher exerts, upon said compacting belt, said compression action that partially counters the expansion of the layer of powder material downstream of the pressing device in a controlled manner, ii) said at least one pusher is separated relative to said compacting belt by means of said pushing gas cushion, iii) said pushing unit exerts on the layer of powder material the second pressure to control the expansion of the layer of powder material downstream of the pressing device, and iv) said gas flowing out of said pushing gas cushion into the external environment avoids direct contact between a peripheral projecting edge of the at least one pusher and the compacting belt. direction.

2. The device according to claim 1, wherein the first pressure is at least fifty times greater than the second pressure.

3. The device according to claim 1, wherein the recess defines the peripheral projecting edge.

4. The device according to claim 3, wherein said recess comprises at least a main channel and at least a secondary channel, which branches off from the main channel.

5. The device according to claim 4, wherein said secondary channel substantially extends perpendicularly to said main channel.

6. The device according to claim 1, wherein the at least one pusher is made of a material that is porous to gases.

7. The device according to claim 6, wherein said material porous to gases comprises a plastic or metal matrix, which is suited to enable passage of the gas under pressure through the at least one pusher to form the pushing gas cushion.

8. The device according to claim 1, wherein the movable surface is configured to support and convey the layer of powder material in the feeding direction; the compacting surface is arranged above the movable surface; and the second pressure exerted on the layer of powder material by the pushing unit is at least partially oriented downwards.

9. The device according to claim 1, wherein, in use, the layer of powder material is fed forward by the movable surface through a continuous compacting station, which is configured to compact the layer of powder material as it moves forward;

wherein the continuous compacting station comprises the compacting belt and a further flexible compacting belt overlapping the compacting belt;

wherein an upper part of the further flexible compacting belt is substantially horizontal and defines a further compacting surface positioned below and in direct contact with the movable surface, so as to sustain it by resting against it;

wherein the expansion countering device further comprises a lower plate, which is positioned below and in direct contact with the further compacting surface; and wherein pressure exerted on the further flexible compacting belt by the pushing unit is countered by the lower plate.

10. The device according to claim 1, wherein the pushing gas cushion is created where the moveable surface and the compacting belt diverge so as to get farther apart in the feeding direction.

* * * * *